US005269282A

United States Patent [19]

Miyata et al.

[11] Patent Number: 5,269,282

[45] Date of Patent: Dec. 14, 1993

[54] MISFIRE DETECTOR FOR USE IN INTERNAL COMBUSTION ENGINE

[75] Inventors: Shigeru Miyata; Hideji Yoshida; Yoshihiro Matsubara; Yasuo Ito, all of Nagoya, Japan

[73] Assignee: NGK Spark Plug Co., Ltd., Nagoya, Japan

[21] Appl. No.: 865,908

[22] Filed: Apr. 9, 1992

[30] Foreign Application Priority Data

| | | | |
|---|---|---|---|
| Jun. 19, 1991 | [JP] | Japan | 3-146446 |
| Jul. 5, 1991 | [JP] | Japan | 3-165406 |
| Aug. 21, 1991 | [JP] | Japan | 3-209197 |

[51] Int. Cl.[5] ..... F02P 17/00

[52] U.S. Cl. ..... 123/627; 123/655; 73/116; 324/399

[58] Field of Search ..... 123/630, 655, 627; 324/399; 73/116, 117.3

[56] References Cited

U.S. PATENT DOCUMENTS

| | | | |
|---|---|---|---|
| 3,942,102 | 3/1976 | Kuhn et al. | 324/399 |
| 4,117,807 | 10/1978 | Barnard | 123/630 |
| 4,138,710 | 2/1979 | Tsukuru | 123/655 |
| 4,547,734 | 10/1985 | Spaude | 324/395 |
| 4,987,771 | 1/1991 | Iwata | 73/117.3 |
| 5,046,470 | 9/1991 | Entenmann et al. | 123/630 |

FOREIGN PATENT DOCUMENTS

| | | | |
|---|---|---|---|
| 0305347 | 3/1989 | European Pat. Off. . | |
| 60-198377 | 10/1985 | Japan | 123/630 |
| 2-102376 | 4/1990 | Japan | 123/655 |
| 2116329 | 9/1983 | United Kingdom . | |

*Primary Examiner*—Andrew M. Dolinar
*Attorney, Agent, or Firm*—Cooper & Dunham

[57] ABSTRACT

In a misfire detector for use in an internal combustion engine having an ignition coil, an electrical interrupter circuit interrupts a primary current flowing through a primary circuit of the ignition coil by which a spark plug is energized. A voltage divider circuit detects a divided voltage of a spark plug voltage applied across the spark plug. A spark plug voltage detector circuit is provided to detect an attenuation characteristic of a spark plug voltage waveform presented subsequent to a time period predetermined either during a spark action of the spark plug or after an end of the spark action of the spark plug. A peak hold circuit is provided to hold a peak voltage of the spark plug voltage waveform presented after the end of the spark action of the spark plug, so that a distinction circuit determines a misfire on the basis of a peak voltage level or the attenuation characteristics of the spark plug voltage waveform.

10 Claims, 9 Drawing Sheets upon running an engine
at low revolution upon running an engine
at high revolution
with high load

MISFIRE DETECTOR FOR USE IN INTERNAL COMBUSTION ENGINE

BACKGROUND OF THE INVENTION

Field of the Invention

This invention relates to a misfire detector for use in internal combustion engine which is based on the fact that an electrical resistant of the spark plug gap is distinguishable between the case when spark ignites air-fuel mixture gas, and the case when the spark fails to ignite the air-fuel mixture gas injected in a cylinder of the internal combustion engine.

With the demand of purifying emition gas and enhancing fuel efficiency of internal combustion engine, it has been necessary to detect firing condition in each cylinder of the internal combustion engine. In order to detect the firing condition in each of the cylinders, an optical sensor has been installed within the cylinders on one hand. On the other hand, a piezoelectrical sensor has been attached to a seat pad of the spark plug.

In both of the cases, it is troublesome and time-consuming to install the sensor to each of the cylinders, thus increasing the installation cost, and at the same time, taking much time in check and maintenance.

Therefore, it is an object of the invention to provide a misfire detector for use in internal combustion engine which is capable of precisely detecting waveform of a secondary voltage applied to the spark plug installed to each cylinder of the internal combustion engine with a relatively simple structure.

SUMMARY OF THE INVENTION

According to the invention, there is provided a misfire detector for use in internal combustion engine comprising: an ignition coil; an electrical interrupter means which interrupts a primary current flowing through a primary circuit of the ignition coil; a check diode provided in a secondary circuit of the ignition coil; a spark plug; a voltage divider means which detects a shunt voltage (divided voltage) of a secondary voltage (spark plug voltage) applied across the spark plug; a secondary voltage detector circuit (spark plug voltage detector circuit) which detects an attenuation characteristics of a secondary voltage (spark plug voltage) waveform presented subsequent to a time period predetermined either during a spark action of the spark plug or after an end of the spark action; and a distinction circuit which determines a misfire on the basis of the attenuation characteristics.

This type of the misfire detector is employed to a distributorless ignition device in which no distributor is needed. In this type of ignition device, an electrical energy stored the ignition coil electrically charges the static capacity inherent in the spark plug immediately after the spark terminates. The charged voltage forms a secondary voltage of 5~8 KV when the internal combustion engine runs at a high revolution while forming a secondary voltage of 2~3 KV when the internal combustion engine runs at a low revolution. The secondary voltage is rapidly discharged through the electrodes of the spark plug after the termination of the spark when the spark normally ignites the air-fuel mixture gas, since the combustion gas staying between the electrodes is ionized. When the spark fails to ignite the air-fuel mixture gas, the secondary voltage is slowly released through the secondary circuit because of being free from ionized particles which otherwise would be produced in the combustion gas.

Therefore, whether or not misfire occurs in the cylinder of the internal combustion engine is determined by detecting an attenuation time length required for the secondary voltage to descent to a predetermined voltage level after picking up the secondary voltage between the diode and the spark plug.

According to another invention, there is provided a misfire detector for use in internal combustion engine comprising: an ignition coil; an electrical interrupter means which interrupts a primary current flowing through a primary circuit of the ignition coil; a distributor provided in a secondary circuit of the ignition coil; a spark plug; a voltage charging circuit which induces an electromotive voltage in the secondary circuit by energizing the primary circuit of the ignition coil, and deenergizing it after a certain period of time at a predetermined time period after an end of a spark action due to an inductive discharge of the spark plug when the engine runs at low revolution with low load; a voltage divider means which detects a shunt voltage (divided voltage) of a secondary voltage (spark plug voltage) applied across the spark plug; a secondary voltage detector circuit (spark plug voltage detector circuit) which detects an attenuation characteristics of a secondary voltage (spark plug voltage) waveform subsequent to a time period predetermined either during a spark action of the spark plug or after an end of the spark action when the engine runs at high revolution, while detecting an attenuation characteristics of a secondary voltage (spark plug voltage) waveform derived from the voltage charging circuit when the engine runs at low revolution with low load; and a distinction circuit which determines a misfire on the basis of the attenuation characteristics.

This type of the misfire detector is employed to an ignition device in which a distributor is needed. In this type of ignition device, the series gap between the ignition coil and the spark plug works as an air gap. This results in a relatively small electrical energy reserved in the ignition coil after the termination of the spark when the engine runs at a low revolution. The small electrical energy often restricts an enhanced level of the secondary voltage to make it difficult to precisely determine the attenuation characteristics of the secondary voltage.

For this reason, the voltage charging circuit is provided to induce an enhance level of the secondary voltage at times either during establishing the spark between the electrodes or during a predetermined time period immediately after an end of the spark only when the engine runs at a low revolution. The enhance level of the secondary voltage is predetermined to be e.g. 5~7 KV which is high enough to break down the series gap of the distributor, but not enough to break down the spark gap, and thus electrically charging the stray capacity inherent in the spark plug. Discharging time length of the charged capacity changes depending on whether or not ionized gas appears in the combustion gas staying in the spark gap when the spark ignites the air-fuel mixture gas in the cylinder.

The attenuation time length of the secondary voltage is detected after the spark is terminated in the same manner as previously mentioned to determine whether misfire occurs in the cylinder of an internal combustion engine.

Meanwhile, the secondary voltage often becomes excessively enhanced after the termination of the spark so that an electrical discharge occurs between the electrodes of the spark plug when the engine runs at a high revolution with a high load. In this instance, the secondary voltage rapidly descends irrespective of the misfire since the voltage discharge from the stray capacity inherent in the spark plug is carried out at once. This makes it difficult to distinguish the misfire from the normal ignition only by detecting the attenuation characteristics of the secondary voltage.

However, the enhanced voltage level itself of the secondary voltage remarkably differs between the misfire and the normal ignition after the termination of the spark when the engine runs at the high revolution with the high load. That is to say, the spark is likely to be sustained when the spark normally ignites the air-fuel mixture gas to ionize the particles in the combustion gas so that the spark exhausts the electrical energy reserved in the ignition coil after termination of the spark so as to enhance the secondary voltage only by 3~5 KV.

As opposed against this enhanced voltage 3~5 KV, the enhanced secondary voltage exceeds 10 KV when the misfire occurs.

Therefore, whether the misfire occurs or not is determined by detecting the enhanced level of the secondary voltage by means of the peak hold circuit after termination of the spark, or on the basis of the attenuation characteristics.

This makes it possible to obviate the necessity of the optical sensor and the piezoelectrical sensor, thus enabling to provide a misfire detector simple in structure and readily reducible to practical use.

With an addition of the zener diode which allows electric current to flow from the secondary coil to the series gap of the distributor, and prohibiting a certain amount of electric current to flow backward, it is possible to prevent the excessively elevated voltage of the stray capacity from being discharged between the electrodes of the spark plug, and avoiding the secondary voltage from being excessively decreased, thus enabling precise detection on whether the misfire occurs or not.

These and other objects and advantages of the invention will be apparent upon reference to the following specification, attendant claims and drawings.

DETAILED DESCRIPTION OF THE EMBODIMENTS

Figure 1:
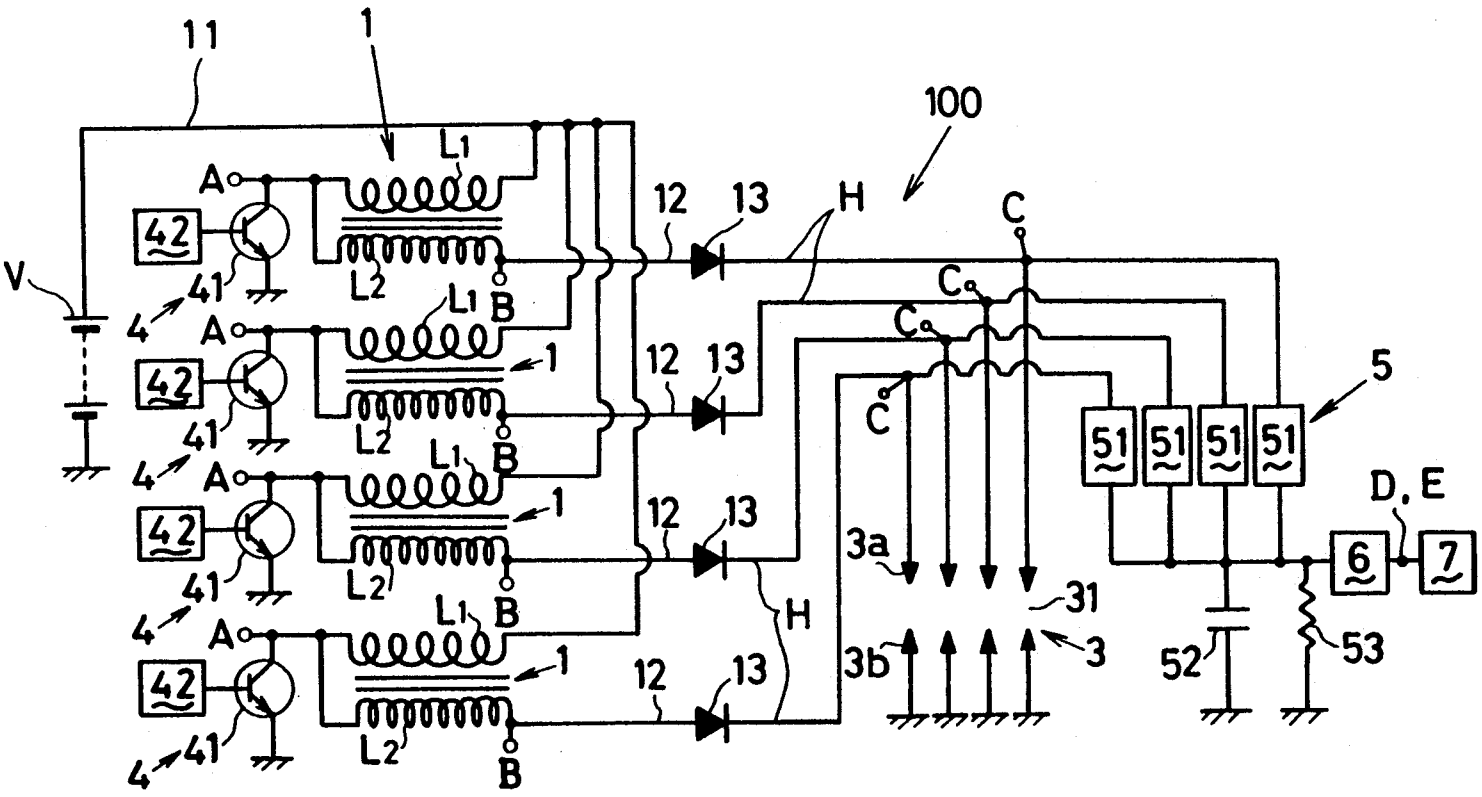
FIG. 1 is a schematic view of an ignition system in which a misfire detector is incorporated according to first embodiment of the invention.

Referring to FIG. 1 which shows a distributorless type of a misfire detector 100 in which no distributor is needed, and incorporated into an internal combustion engine according to first embodiment of the invention, the misfire detector 100 has an ignition coil 1 which includes a primary circuit 11 and a secondary circuit 12 with a vehicular battery cell (V) as a power source. The number of the ignition coil 1 provided in the first embodiment corresponds to that of the cylinders of the internal combustion engine.

The primary circuit 11 has a primary coil (L1) electrically connected in series with a switching device 41 and a signal generator 42, while the secondary circuit 12 has a secondary coil (L2) and a diode 13 connected in series with each other. A lead wire (H) connects the diode 13 to a spark plug 3 installed in each cylinder of the internal combustion engine. The spark plug 3 has a center electrode 3*a* and an outer electrode 3*b* to form a spark gap 31 between the two electrodes 3*a*, 3*b*, across which spark occurs when energized.

The switching device 41 and the signal generator 42 form an interrupter circuit 4 which detects a crank angle and a throttling degree of the engine to interrupt primary current flowing through the primary coil (L1) to induce a secondary voltage (spark plug voltage) in the secondary coil (L2) of the secondary circuit 12 so that the timing of the spark corresponds to an advancement angle relevant to a revolution and load which the engine bears.

Meanwhile, an electrical conductor 51 is disposed around an extension line of the lead wire (H) to define static capacity of e.g. 1~3 pF therebetween through an insulator so as to form a voltage divider circuit 5. The conductor 51 is connected to the ground by way of a shunt condensor 52. To a common point between the conductor 51 and the shunt condensor 52, is a secondary voltage detector circuit (spark plug voltage detector circuit) 6 electrically connected to which a distinction circuit 7 is connected. The shunt condensor 52 has static capacity of e.g. 3000 pF to serve as a low impedance element, and the shunt condensor 52 further has an electrical resistor 53 (e.g. 3 MΩ) connected in parallel therewith so as to form a discharge path for the shunt condensor 52.

The voltage divider circuit 5 allows to divide the secondary voltage induced from the secondary circuit 12 by the order of 1/3000, which makes it possible to determine the time constant of RC path to be approximately 9 milliseconds to render an attenuation time length relatively longer (2~3 milliseconds) as described hereinafter.

Figure 2:
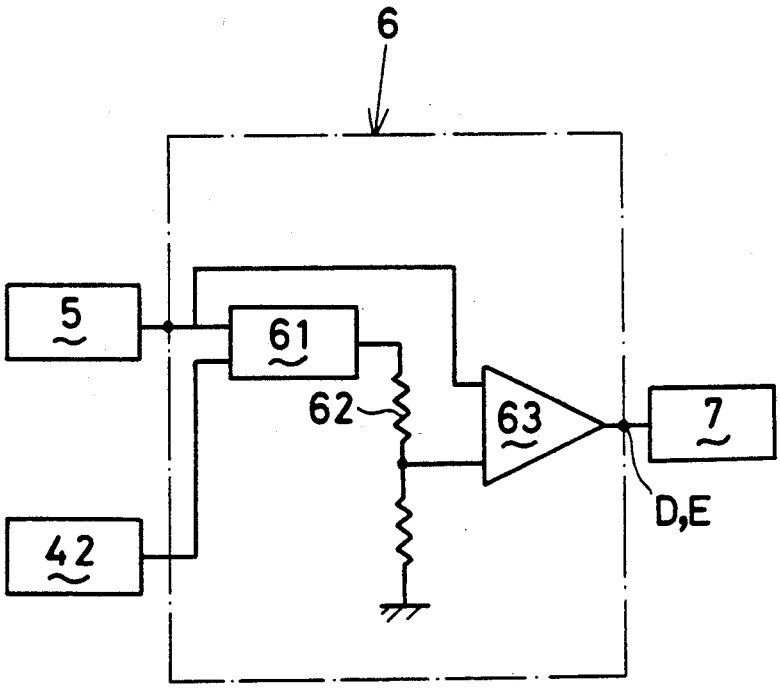
FIG. 2 shows a wiring diagram of a secondary voltage detector circuit.

In this instance, the secondary voltage (spark plug voltage) 30000 V divided to a level of 10 V is inputted to the secondary voltage detector circuit 6. As shown in FIG. 2, the secondary voltage detector circuit 6 has a peak hold circuit 61 which is adapted to be reset at the time determined by the signal generator 42 in order to hold an output voltage generated from the voltage divider circuit 5. The secondary voltage detector circuit 6 further has a shunt circuit 62 which divides an output from the peak hold circuit 61, and having a comparator 63 which generates pulse signals by comparing an output from the shunt circuit 62 with that of the voltage divider circuit 5.

Into the distinction circuit 7, is a microcomputer incorporated which compares output pulse singals with data previously determined by calculation and experiment so as to determine whether the misfire occurs or not in the cylinder of the internal combustion engine.

Figure 3:
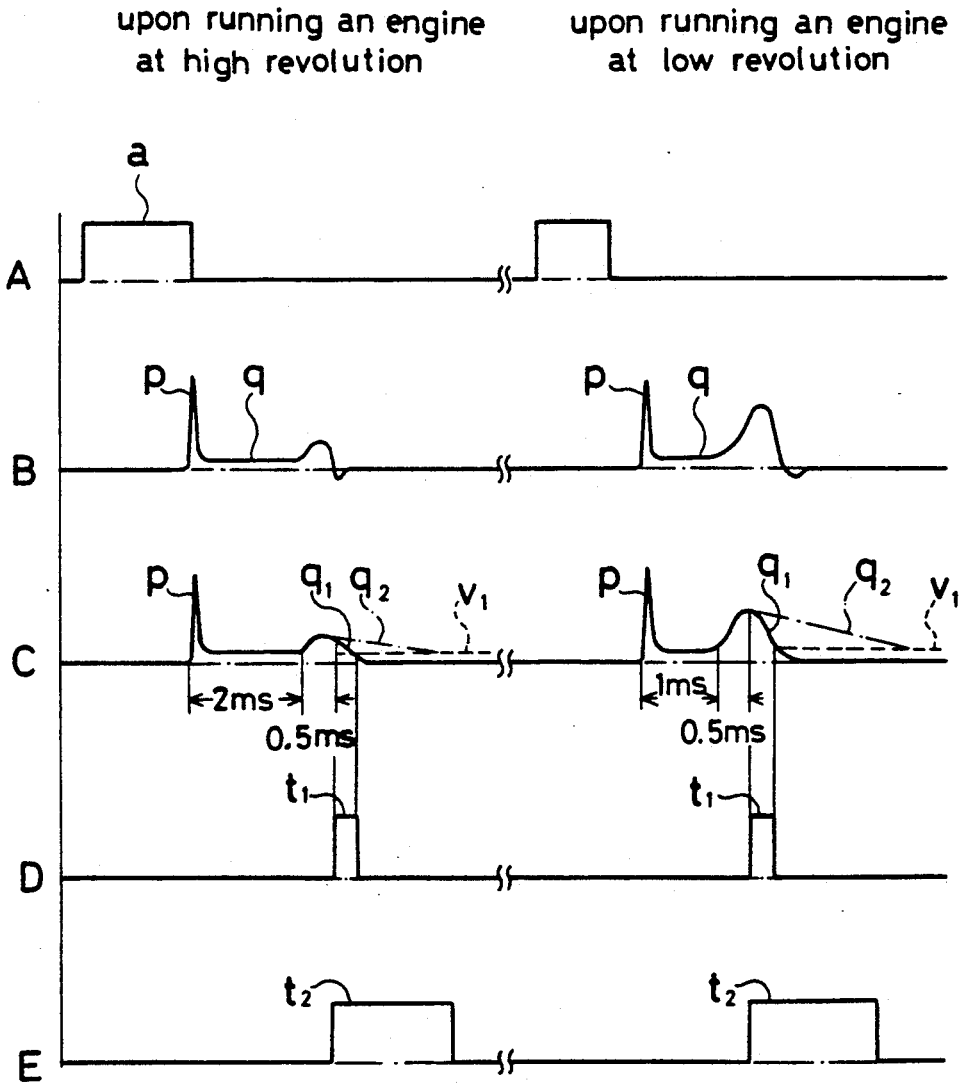
FIG. 3 is a view of a voltage waveform shown for the purpose of explaining how the secondary voltage detector circuit works.

With the structure thus far described, the signal generator 42 on-off actuates the switching device 41 to output pulse signals (a) as shown at (A) in FIG. 3 in order to induce a secondary voltage in the secondary coil L2 as shown at (B) in FIG. 3 in which an termination of the pulse signals (a) accompanies a high voltage waveform (p) to initiate the spark across the electrodes 3*a*, 3*b*, and succeeding a low inductive discharge (q) following the high voltage waveform (p).

Upon running the engine at a low revolution, the low inductive discharge (q) which forms a secondary voltage waveform sustains for approximately 2 ms, and disappears with an exhaustion of an electrical energy reserved in the ignition coil 1. The exhaustion of the electrical energy culminates the secondary voltage in 2~3 KV. Upon running the engine at a high revolution, the low inductive discharge (q) which forms the secondary voltage waveform sustains for approximately 1 ms, and disappears with the exhaustion of the electrical energy reserved in the ignition coil 1. The exhaustion of the electrical energy culminates the secondary voltage in 5~8 KV.

A secondary voltage waveform between the diode 13 and the spark plug 3 is derived in main from the discharge of the stray capacity (usually 10~20 pF) inherent in the spark plug 3 after the spark terminates. An attenuation time length of the secondary voltage waveform differs between the case when the spark normally ignites the air-fuel mixture gas and the case when the spark fails to ignite the air-fuel mixture gas.

That is, the discharge from the stray capacity is released through ionized particles of the combustion gas upon carrying out the normal ignition, so that the secondary voltage waveform rapidly attenuates as shown at solid lines (q1) of (C) in FIG. 3. The misfire makes the combustion gas free from the ionized particles, so that the discharge from the stray capacity leaks mainly through the spark plug 3. The secondary voltage waveform slowly attenuates as shown at phantom lines (q2) of (C) in FIG. 3.

In the meanwhile, an average value of the spark sustaining time length is determined according to operating conditions obtained from calculation and experiment based on the revolution, the workload of the engine and the design of the ignition system. The signal generator 41 is adapted to carry out the reset and peak hold timing of the peak hold circuit 61 by approximately 0.5 ms later following the expiration of the average value of the spark sustaining time length.

The peak hold circuit 61 holds a charged voltage of the stray capacity inherent in the spark plug 3, while the shunt circuit 62 divides the charged voltage. With ⅓ of the charged voltage as a reference voltage (v1), the comparator 63 compares the reference voltage (v1) with the output voltage waveform from the voltage divider circuit 5. The comparator 63 generates a shorter pulse (t1) as shown (D) in FIG. 3 when the spark normally ignites the air-fuel mixture gas, while generating a wider pulse (t2) as shown (E) in FIG. 3 when the misfire occurs.

The pulses (t1), (t2) are fed into the distinction circuit 7 so as to cause the circuit 7 to determine the misfire when the attenuation time length is more than 3 ms upon running the engine at the low revolution (1000 rpm), while determining the misfire when the attenuation time length is more than 1 ms upon running the engine at the high revolution (6000 rpm). The distinction circuit 7 further determines the misfire when the attenuation time length is more than the one decreasing in proportion to the engine revolution which falls within an intermediate speed range between 1000 and 6000 rpm.

It is preferable that the secondary voltage is maintained positive by reversely connecting the ignition coil 1 since the ionized particles in the air-fuel mixture gas allows electric current to flow better when the center electrode 3*a* is kept more positive than it would be connected otherwise.

Figure 4:
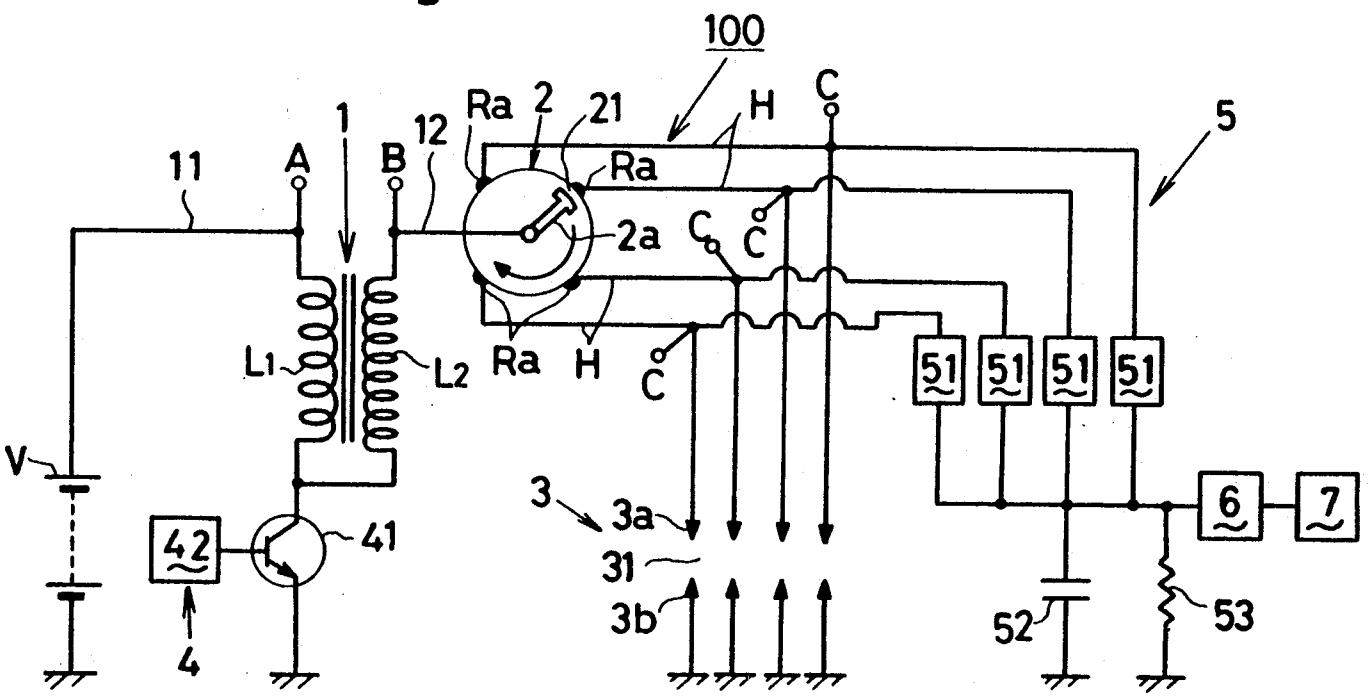
FIG. 4 is a view similar to FIG. 1 according to second embodiment of the invention.

FIG. 4 shows second embodiment of the invention in which like reference numerals in FIG. 4 are identical to those in FIG. 1. A main portion in which the second embodiment differs from the first embodiment is that a distributor 2 is provided according to the second embodiment of the invention.

In the second embodiment of the invention in which only a single ignition circuit is necessary as designated at numeral 1 as the same manner in FIG. 1, the secondary coil (L2) of the secondary circuit 12 is connected directly to a rotor 2*a* of the distributor 2. The distributor 2 has stationary segments (Ra), the number of which corresponds to that of the cylinders of the internal combustion engine. To each of the stationary segments (Ra), is an free end of the rotor 2*a* adapted to approaches so as to make a rotor gap 21 (series gap) with the corresponding segments (Ra). Each of the segments (Ra) is connected to the spark plug 3 by way of the high tension cord (H). The spark plug 3 has a center electrode 3*a* and an outer electrode 3*b* to form a spark gap 31 between the two electrodes 3*a*, 3*b* across which spark occurs when energized.

The interrupter circuit 4 which is formed by the switching device 41 and the signal generator 42 serves as a voltage charging circuit according to the second embodiment of the invention.

Upon running the engine at a relatively low revolution less than 3000 rpm, the enhanced level of the secondary voltage is such a degree as to limit the voltage level charged in the stray capacity of the spark plug 3 by way of the series gap 21 after the spark terminates, thus rendering it impossible to precisely determine the attenuation characterics of the secondary voltage. In this instance, it is advantageous to independently induce an increased level of the secondary voltage based on the voltage charging circuit.

The voltage charging circuit is adapted to selectively on-off actuates the primary coil (L1) so as to induce a charging voltage in the secondary circuit 12 either during establishing the spark between the electrodes 3*a*, 3*b* or during a predetermined time period immediately after an end of the spark, thus leading to electrically charging the stray capacity inherent in the spark plug 3.

The voltage charging circuit is actuated only upon running the engine at a relatively low revolution less than 3000 rpm. Upon running the engine at the high revolution more than 3000 rpm, it is needless to activate the voltage charging circuit since the secondary voltage is excited to reach 5~8 KV enough to positively break down the series gap 21. A range which the voltage charging circuit is actuated is appropriately determined depending on a type of the internal combustion engine, and adjusted by operating conditions such as the load of the engine, temperature of cooling water and the vehicular battery cell (V).

Figure 5:
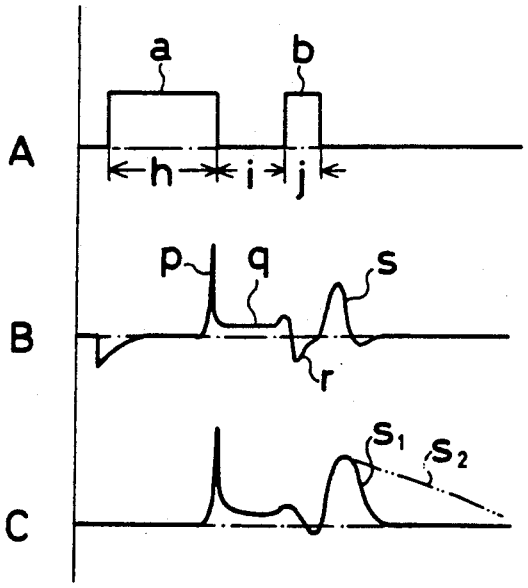
FIG. 5 is a schematic view of a voltage waveform shown for the explaining purpose according to the second embodiment of the invention.

The ignition detector 100 is operated in the same manner as described in the first embodiment of the invention, upon running the engine at the high revolution more than 3000 rpm. Upon running the engine at the relatively low revolution less than 3000 rpm, the misfire detector 100 is operated as follows:

The signal generator 42 of the interrupter circuit 4 outputs pulse signals in order to induce the primary current in the primary circuit 11 as shown at (A) in FIG. 5. Among the pulse signals, the pulse (a) which has a larger width (h) energizes the spark plug 3 to establish the spark between the electrodes 3*a*, 3*b*.

The pulse (a) followed by the pulses (b) delays by the time (i) of 1.5~2.5 ms. The pulse (b) has a small width (j) to electrically charge the stray capacity inherent in the spark plug 3.

In so doing, the time length during which the free end of the rotor 2*a* forms the rotor gap 21 with each of the segments (Ra), changes depending on the revolution of the engine. The pulse width (h) and the delay time (i) are preferably determined relatively shorter (1.5 ms) in a manner that the spark sustains for 0.5~0.7 ms when the engine is running within a range of the intermediate revolution.

With the actuation of the interruter circuit 4, the secondary voltage appears in the secondary coil (L2) of the secondary circuit 12 as shown at (C) in FIG. 5. Due to the high voltage (p) established following the termination of the pulse signal (a), the spark starts to occur across the electrodes 3*a*, 3*b* so as to succeed an inductive discharge waveform (q) slowly until the spark terminates.

In response to the rise-up pulse signal (b), a counter-electromotive voltage accompanies a negative voltage waveform (r) flowing through the secondary circuit 12, thus making it possible to terminate the spark when the spark lingers. Due to an electrical energy stored in the ignition coil 1 when the primary coil (L1) is energized, the secondary voltage is enhanced again to draw a voltage waveform (s) through the secondary circuit when the primary coil (L1) is deenergized. The enhanced voltage level is determined as desired by the delay time (i) and the width (j) of the pulse signal (b). The level of the voltage waveform (s) is determined to be 5~7 KV, the intensity of which is enough to break down the rotor gap 21, but not enough to establish a discharge across the electrodes 3*a*, 3*b* when free from ionized particles.

The discharge voltage in main from the stray capacity (usually 10~20 pF) inherent in the spark plug 3, is released as shown at (C) in FIG. 5. The attenuation time length of the discharge voltage is distinguishable the case when the spark normally ignites the air-fuel mixture gas from the case when the spark fails to ignite the air-fuel mixture gas injected in each cylinder of the internal combustion engine. That is to say, the misfire follows a slowly attenuating waveform (s2) of (C) as shown in FIG. 5, while the normal ignition follows an abruptly attenuating waveform (s1) of (C) as shown in FIG. 5.

The secondary voltage detector circuit 6 detects a voltage waveform more than a reference voltage level (v1) so as to change the voltage waveform into square wave pulses, each width of which is equivalent to the attenuation time length. The square wave pulses are inputted to the distinction circuit 7 so as to cause the circuit 7 to determine the misfire when the attenuation time length is more than 3 ms (1 ms) with the revolution of the engine as 1000 rpm (6000 rpm). The distinction circuit 7 further determines the misfire when the attenuation time length is more than the one decreasing in proportion to the engine revolution which falls within the intermediate speed range between 1000 and 6000 rpm in the same manner as described in the first embodiment of the invention.

It is noted that one way diode may be electrically connected between the rotor 2*a* of the distributor 2 and the secondary coil (L2) of the secondary circuit 12. The diode allows electric current to flow from the secondary coil (L2) to the rotor 2*a* of the distributor 2, but prohibits the electric current to flow backward. The diode prevents an excessively charged voltage 5~7 KV from inadvertently flowing backward to the ignition coil 1 by way of the series gap 21. This enables to avoid an abrupt rise-up voltage in the ignition coil so as to contribute to a precise detection of the misfire.

It is also noted that the secondary voltage level held by the peak hold circuit 61 may be based on the detection of the misfire instead of the attenuation time length.

Figure 6:
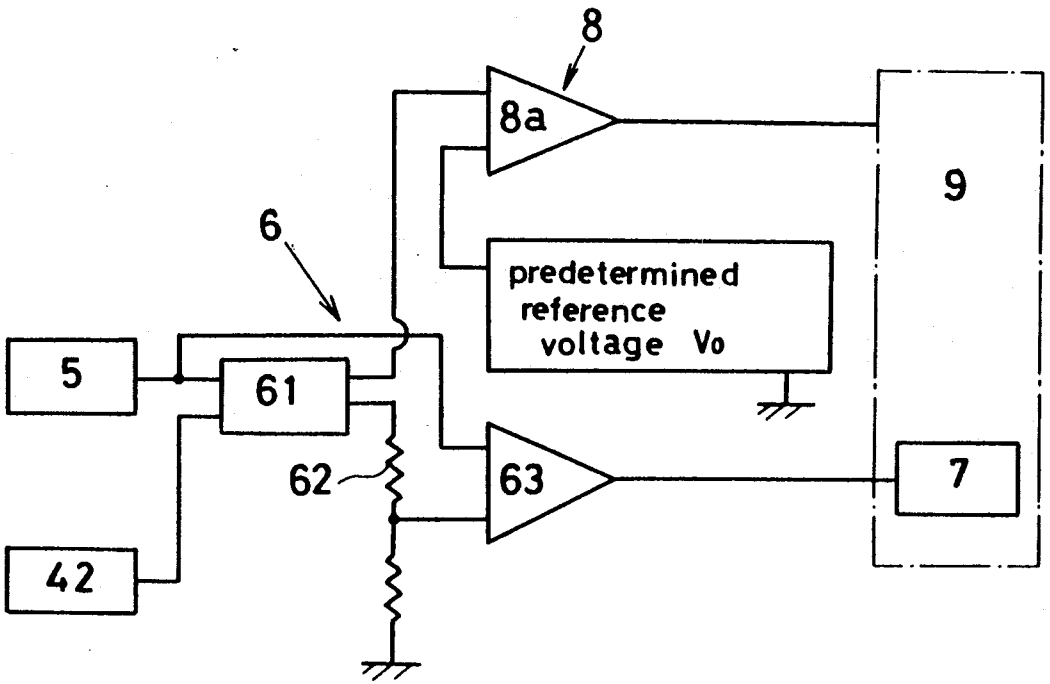
FIG. 6 shows a wiring diagram of a secondary voltage detector circuit according to third embodiment of the invention.

FIG. 6 shows third embodiment of the invention in which like reference numerals in FIG. 6 are identical to those in FIG. 2. Numeral 8 designates a level detector circuit which has a comparator 8*a* to compare a predetermined reference voltage (Vo) with a peak voltage value held by the peak hold circuit 61 so as to generate output pulses. The output pulses are fed into an auxiliary distinction circuit 9 which determines the misfire depending on the level of the output pulses.

Figure 7:
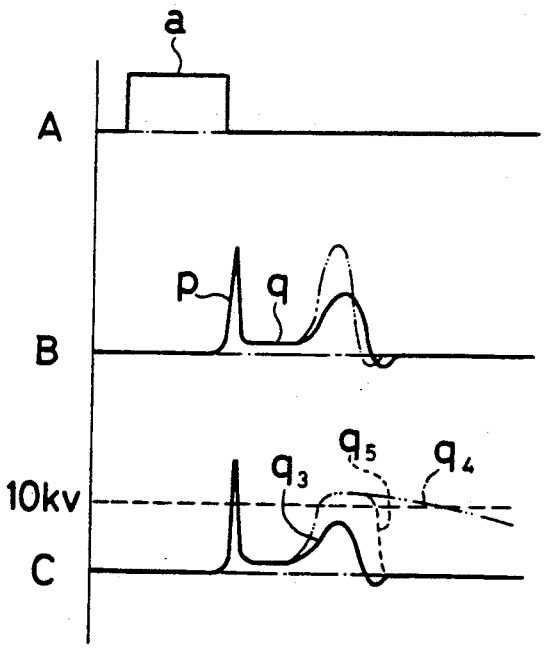
FIG. 7 is a view of a voltage waveform shown for the purpose of explaining how the secondary voltage detector circuit works according to the third embodiment of the invention.

FIG. 7 shows a waveform of the secondary voltage upon running the engine at full revolution (5000 rpm) with high load. An enhanced voltage level of the secondary voltage remains only 3~5 KV as shown at (q3) of (C) in FIG. 7 when the spark normally ignites the air-fuel mixture gas. The secondary voltage may rise to 10 KV or more as shown at (q4) of (C) in FIG. 7 when the spark fails to ignite the air-fuel mixture gas. The subsequent spark causes to abruptly descend the rise-up secondary voltage as shown at (q5) of (C) in FIG. 7. The abruptly descended waveform (q5) makes it difficult to distinguish the attenuation characteristics of the normal ignition from that of the misfire.

As opposed against this instance, it is possible to positively distinguish the normal ignition from the misfire upon running the engine at the high revolution by directly detecting the enhanced level of the secondary voltage, and judging whether the enhanced level exceeds the predetermined reference voltage (Vo e.g. 10 KV) or not.

Figure 8:
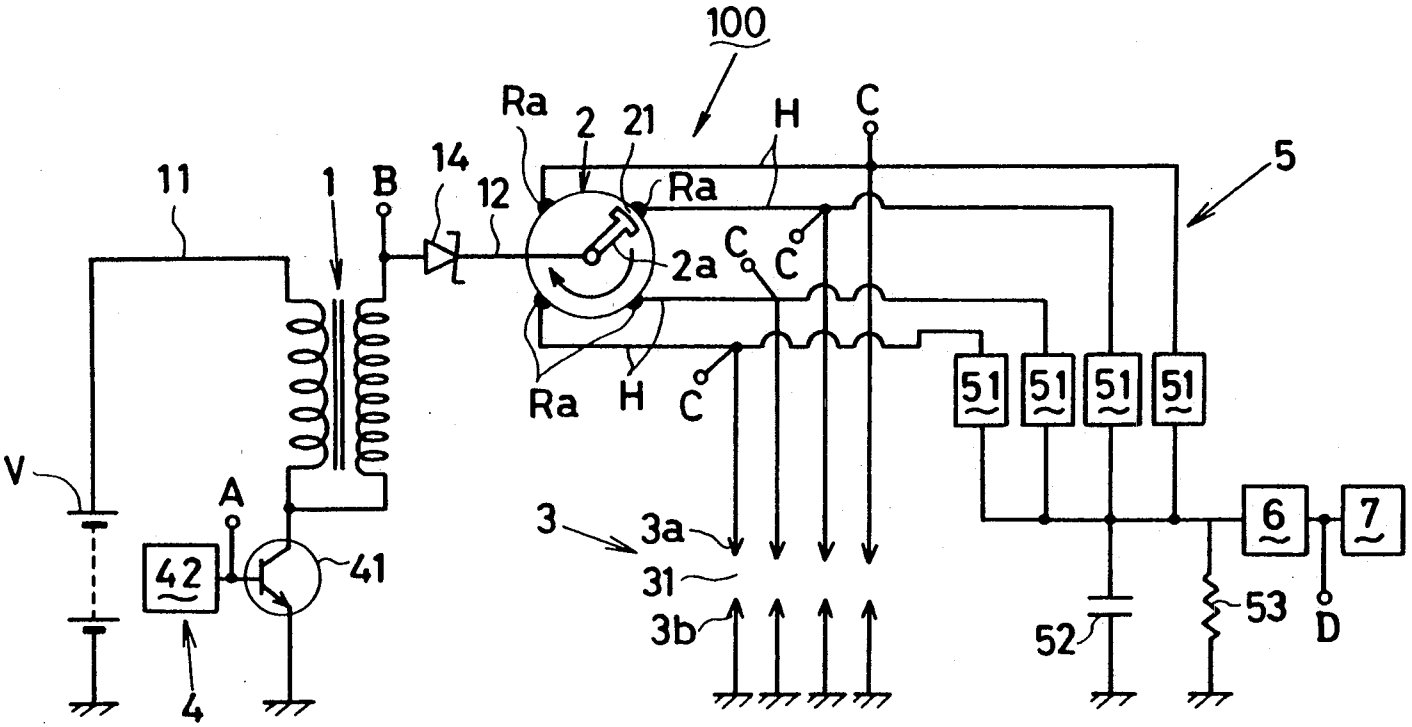
FIG. 8 is a view similar to FIG. 1 according to fourth embodiment of the invention.
Figure 9:
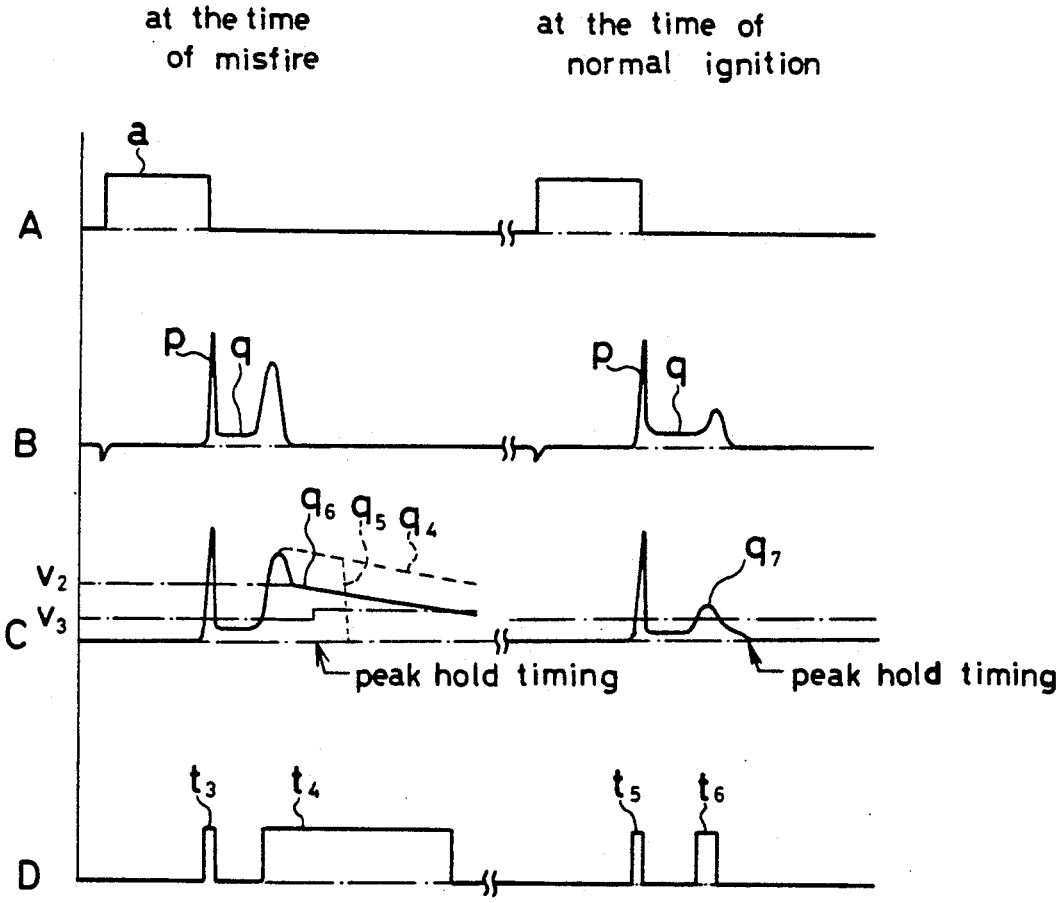
FIG. 9 is a view of a voltage waveform shown for the purpose of explaining how the secondary voltage detector circuit works according to the fourth embodiment of the invention.

FIGS. 8, 9 show fourth embodiment of the invention in which like reference numerals in FIG. 8 are identical to those in FIG. 4. Between the secondary coil (L2) of the secondary circuit 12 and the series gap 21 of the distributor 2, is a zener diode 14 electrically connected to avoid the abruptly descended waveform (q5) of (C) in FIG. 7.

With the addition of the zener diode 14, a waveform (q6) of the secondary voltage changes so that it slowly descends from a zener voltage (vz) which is determined by characteristics of the zener diode 14 as shown at (C) in FIG. 9. The zener voltage (vz) is not high enough to break down the spark gap 31.

In the secondary voltage detector circuit 6, the peak hold circuit 61 holds a peak voltage at an appropriate time after the waveform (q6) of the secondary voltage starts to slowly descend. With ⅔ of the peak hold voltage as a reference voltage (v3), the comparator 63 compares it with an output voltage waveform from the voltage divider circuit 5. As shown in (D) in FIG. 9, the comparator 63 produces square pulses (t3), (t4) or (t5), (t6), each width of which is equivalent to time length during which the secondary voltage is held at more than the reference voltage (v3).

In the case of the normal ignition, a waveform (q7) of the secondary voltage substantially disappears when the peak hold circuit 61 begins to hold a peak voltage at the appropriate time. However, the misfire is judged by predetermining a minimum level of the reference voltage (v3), since no voltage exceeding the reference voltage (v3) is detected after the peak hold circuit 61 holds a peak voltage.

It is appreciated that instead of the zener diode 14, is a diode used which can withstands 5~8 KV.

It is also appreciated that instead of the zener diode 14, is an electrical unit used in which a diode is connected in parallel with a varistor.

Further, it is noted that the zener diode 14 may be employed to the second embodiment of the invention shown in FIG. 4 in which the pulse (b) generated by the signal generator 42 induces the enhanced voltage in the secondary circuit 12 either during the inductive discharge or after the termination of the inductive discharge.

Moreover, it is noted that the employment of the zener diode 14 enables to prevent an excessively enhanced voltage from flowing back to the ignition coil 1 due to design variation of the ignition coil 1 and the vehicular battery cell (v), thus making it easy to determine conditions for detecting the misfire.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A misfire detector for use in internal combustion engine comprising:

an ignition coil;

an electrical interrupter means which interrupts a primary current flowing through a primary circuit of the ignition coil;

a distributor provided in a secondary circuit of the ignition coil;

a spark plug;

a voltage charging circuit which induces an electromotive voltage in the secondary circuit by energizing the primary circuit of the ignition coil, and deenergizing it after a certain period of time at a predetermined time period after an end of a spark action due to an inductive discharge of the spark plug when the engine runs at low revolution with low load;

a voltage divider means which detects a shunt voltage of a secondary voltage applied across the spark plug;

a secondary voltage detector circuit which detects an attenuation characteristics of a secondary voltage waveform subsequent to a time period predetermined either during a spark action of the spark plug or after an end of the spark action when the engine runs at high revolution, while detecting an attenuation characteristics of a secondary voltage waveform derived from the voltage charging circuit when the engine runs at low revolution with low load; and a distinction circuit which determines a misfire on the basis of the attenuation characteristics.

2. A misfire detector for use in an internal combustion engine as recited in claim 1, wherein a peak hold circuit is provided to hold a peak voltage of the secondary voltage waveform presented after the end of the spark action, so that the distinction circuit determines a misfire on the basis of a peak voltage level or the attenuation characteristics of the secondary voltage.

3. A misfire detector for use in an internal combustion engine as recited in claim 1, wherein a zener diode is connected between the ignition coil of the secondary circuit and the series gap, so that a misfire is determined on the basis of the attenuation characteristics of the secondary voltage waveform presented subsequent to a time period predetermined after the end of the spark action.

4. A misfire detector for use in an internal combustion engine comprising:

an ignition coil;

an electrical interrupter means which interrupts a primary current flowing through a primary circuit of the ignition coil;

a current flow-back prevention means provided in a secondary circuit of the ignition coil so as to prevent a current flow back to the ignition coil;

a spark plug which is to be energized from the ignition coil;

a voltage charging means which works to electrically charge a stray capacity inherent in the spark plug by either on-off actuating the primary current of the ignition coil or by supplying an electric power source after an end of a spark action of the spark plug;

a voltage detection means which detects a voltage of a spark plug voltage applied across the spark plug;

a spark plug voltage characteristic detector means which detects an attenuation time period of length of a spark plug voltage waveform presented subsequent to a time period predetermined after the end of the spark action of the spark plug; and a distinction means provided to determine a misfire on the basis of the attenuation time period length of the spark plug voltage waveform.

5. A misfire detector for use in an internal combustion engine as recited in claim 4, wherein the current flow-back prevention means is selected from the group consisting of a check diode and a series gap, the check diode is connected between the ignition coil and a distributor, and the series gap is formed as a rotor gap of the distributor.

6. A misfire detector for use in an internal combustion engine as recited in claim 4, wherein the spark plug voltage characteristic detector means is adapted to determine a reference voltage from a peak value of a charged voltage in the stray capacity so as to detect the attenuation time period length of the spark plug voltage waveform.

7. A misfire detector for use in an internal combustion engine comprising:

an ignition coil;

an electrical interrupter means which interrupts a primary current flowing through a primary circuit of the ignition coil;

a current flow-back prevention means provided in a secondary circuit of the ignition coil so as to prevent a current flow back to the ignition coil;

a spark plug which is to be energized from the ignition coil;

a voltage charging means being a high voltage stored in the ignition coil so as to electrically charge a stray capacity inherent in the spark plug after an end of a spark action of the spark plug;

a voltage detection means which detects a voltage of a spark plug voltage applied across the spark plug;

a spark plug voltage characteristic detector means which detects an attenuation time period length of a spark plug voltage waveform presented subsequent to a time period predetermined after the end of the spark action of the spark plug; and a distinction means provided to determine a misfire on the basis of the attenuation time period length of the spark plug voltage waveform.

8. A misfire detector for use in an internal combustion engine as recited in claim 7, wherein a peak hold circuit is provided to hold a peak voltage of the spark plug voltage waveform presented after the end of the spark action of the spark plug, so that the distinction means determines a misfire on the basis of a peak voltage level or the attenuation time period length of the spark plug voltage waveform.

9. A misfire detector for use in an internal combustion engine as recited in claim 7, wherein a zener diode is connected between the ignition coil of the secondary circuit and a series gap of the distributor in order to prevent an electric current less than a corresponding voltage charged in the stray capacity from flowing back to the ignition coil, so that a misfire is determined on the basis of the attenuation time period length of the spark plug voltage waveform presented subsequent to a time period predetermined after the end of the spark action of the spark plug.

10. A misfire detector for use in an internal combustion engine comprising:

an ignition coil;

an electrical interrupter means which interrupts a primary current flowing through a primary circuit of the ignition coil;

a current flow-back prevention means provided in secondary circuit of the ignition coil so as to prevent a current flow back to the ignition coil;

a spark plug which is to be energized from the ignition coil;

a voltage charging means which includes an electromotive voltage in the secondary circuit by energizing the primary circuit of the ignition coil, and deenergizes it after a certain period of time at a predetermined time period after an end of a spark action so as to electrically charge a stray capacity inherent in the spark plug when the engine runs at a low speed with a low load;

a voltage detection means which detects a voltage of a spark plug voltage applied across the spark plug;

a spark plug voltage characteristic detector means which detects an attenuation time period length of a spark plug voltage waveform presented subsequent to a time period predetermined either during a spark action of the spark plug or after an end of the spark action of the spark plug when the engine runs at a high speed, while detecting an attenuation time period length of a spark plug voltage waveform derived from the voltage charging means when the engine runs at low speed with a low load; and a distinction means which determines a misfire on the basis of the attenuation time period length of the spark plug voltage waveform.

* * * * *